United States Patent [19]

Mulry

[11] 4,444,075

[45] Apr. 24, 1984

[54] PAPER EJECTION ATTACHMENT FOR CUTTING DIE

[76] Inventor: Lawrence S. Mulry, 517 W. Arch St., Frackville, Pa. 17931

[21] Appl. No.: 410,038

[22] Filed: Aug. 20, 1982

Related U.S. Application Data

[63] Continuation-in-part of Ser. No. 202,185, Oct. 28, 1980, abandoned.

[51] Int. Cl.[3] ..... B26F 1/44

[52] U.S. Cl. ..... 83/128; 83/139; 83/653

[58] Field of Search ..... 83/128, 139, 125, 652, 83/653, 140, 138

[56] References Cited

U.S. PATENT DOCUMENTS

| | | | |
|---|---|---|---|
| 389,763 | 9/1888 | Rock | 83/128 |
| 1,471,653 | 10/1923 | Fitzgerald | 83/652 |
| 1,474,048 | 11/1923 | Lynch | 83/128 X |
| 1,650,314 | 11/1927 | Ackermann | 83/139 X |
| 1,670,898 | 5/1928 | Messmer, Jr. | 83/128 |
| 2,038,743 | 4/1936 | Lindholm | 83/128 |
| 2,124,591 | 7/1938 | Ryan | 83/128 X |
| 2,129,448 | 9/1938 | Short | 83/652 X |
| 2,214,743 | 9/1940 | Lamb | 83/128 X |
| 2,324,857 | 7/1943 | Leskiewicz | 83/128 |
| 3,373,643 | 3/1968 | Spengler | 83/653 X |

*Primary Examiner*—Frank T. Yost

*Attorney, Agent, or Firm*—Harvey B. Jacobson

[57] ABSTRACT

A die ejecting plate has a large block of rubber bonded to one of its planar surfaces and is fixedly attachable to a topmost portion of a conventional paper cutting die. Once attached to the paper cutting die, the ejecting plate is so positioned that the block of rubber extends downwardly into the die. A die cutting press may then be used to drive the paper cutting die through a stack of paper, and once the hammer of the press is removed from contact with the die, the block of rubber serves to forcibly extract the die from the material cut.

3 Claims, 7 Drawing Figures

PAPER EJECTION ATTACHMENT FOR CUTTING DIE

BACKGROUND OF THE INVENTION

CROSS REFERENCE TO RELATED APPLICATIONS

This application comprises a continuation-in-part of my copending application Ser. No. 202,185, filed Oct. 28, 1980, for PAPER EJECTION ATTACHMENT FOR CUTTING DIE, now abandoned.

FIELD OF THE INVENTION

The present invention relates to die cutters for sheet materials, and more particularly pertains to a portable die ejecting system attachable to cutting dies utilized for cutting through paper or the like.

DESCRIPTION OF THE PRIOR ART

With respect to hollow dies as may be used for cutting parts from sheet stock, such as gasket materials, paper, fiberboard, and the like, it has been a common and conventional practice to place a chunk of rubber within the dies to act as an ejector which will remove the cutout material forced into the interior of the hollow die during a cutting operation on the sheet stock. However, this type of die and ejector combination is characterized by the disadvantage that the chunk of rubber must be manually positioned beneath the hollow die cutter prior to the cutter being driven through the sheet stock. Once the cutter is retracted by its driving mechanism, the chunk of rubber serves to eject the material from the cutter and the rubber must then be manually removed from the top of the cut material prior to its removal from the cutting surface. As is apparent, this manual positioning and removing of the chunk of rubber utilized as an ejector contributes substantially to the cost of die-cut items, which of necessity must be produced in the most economical manner for competitive reasons.

Another type of hollow die that has been heretofore used makes no use of an ejector, but rather permits each slug of cut material to remain in the hollow interior thereof, and the next slug of cut material then forces the first slug upwardly through the die so as to eject the same therefrom. However, this type of cutting die has been characterized by a consistent jamming of the slugs of material within the interior of the die, thus requiring down time for maintenance as well as often resulting in a rupture of the die body. Additionally, this particular configuration of die cutter has been able to accommodate only certain types of stock, and further these units have been of substantially expensive manufacture because of the necessary open back plate or platen configuration and guide tubes associated with the apparatus.

There have been some attempts to develop a hollow die cutter which will automatically eject cut material after a cutting operation and which does not require the positioning of a rubber block over the material to be cut prior to such cutting operation. In this respect, U.S. Pat. No. 3,137,188, issued to F. Domka on June 16, 1964, discloses a hollow die cutter which serves as a mount or guide for an inner ejector. The inner ejector is connected with an outer stock follower surrounding the exterior of the cutter and controlling the movement of the ejector so as to provide a self-cleaning of the cut slug from the interior of the die. Further, the ejectment action is delayed so that the cutout slug is ejected from the die only after the die has been completely elevated above the sheet by the withdrawal of a cutting press ram. In this respect, the cutting die and the ejectment mechanism of Domka is fixedly secured to the ram or hammer of the cutting press.

Similarly, in U.S. Pat. No. 3,827,322, issued to Saunders et al on Aug. 6, 1974, there is illustrated a resilient ejection strip for use with a cutting die. In this connection, a resilient ejection strip is located within the hollow cavity formed by the cutting die and operates to eject the severed pieces of sheet material so as to eliminate any need for their manual removal therefrom. However, as with the Domka device, the ejectment means of Saunders et al is designed for use with a hollow die that is fixedly secured to a cutting press ram or hammer. Effectively then, both the Domka and Saunders et al ejectment mechanisms operate to remove material from the hollow dies, while the press ram or hammer serves to remove the dies from the sheet material.

SUMMARY OF THE INVENTION

The present invention, which will be described subsequently in greater detail, provides a paper cutting die ejection attachment for use on a portable cutting die which has all of the advantages of the prior art devices and none of the disadvantages. To attain this, the present invention envisions the use of a die ejecting plate which has a block of rubber bonded thereto and which is fixedly securable to a topmost portion of a portable hollow cutting die. The plate is provided with a plurality of cutouts whereby the top of the cutting die is not completely covered thereby to permit an expansion of the material being cut upwardly past the plate. Further, a plurality of steel connection bars are provided for attachment to an interior portion of the cutting die, such connection bars serving as the points of connection between the die ejecting plate and the associated hollow cutting die. Effectively then, the present invention is directed to a portable die designed for automatic extraction from the stock sheet being cut, as opposed to the type of cutting die fixedly attached to a cutting press ram or hammer which utilizes an ejection means designed exclusively to remove the cut stock from the die.

It is an object of the present invention to provide a paper cutting die ejection attachment for a cutting die which is lightweight in construction and which may be easily and economically manufactured.

A further object of the present invention is to provide a portable die ejecting system which permits an automatic extraction of a die from stock sheet.

Still another object of the present invention is to provide a die extractor which is particularly designed for use with portable hollow cutting dies.

A yet further object of the present invention is to provide a portable cutting die which will automatically extract itself from cut sheet stock.

Even another object of the present invention is to provide a portable cutting die which is particularly designed for use in cutting paper blanks which will be subsequently converted into envelopes.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
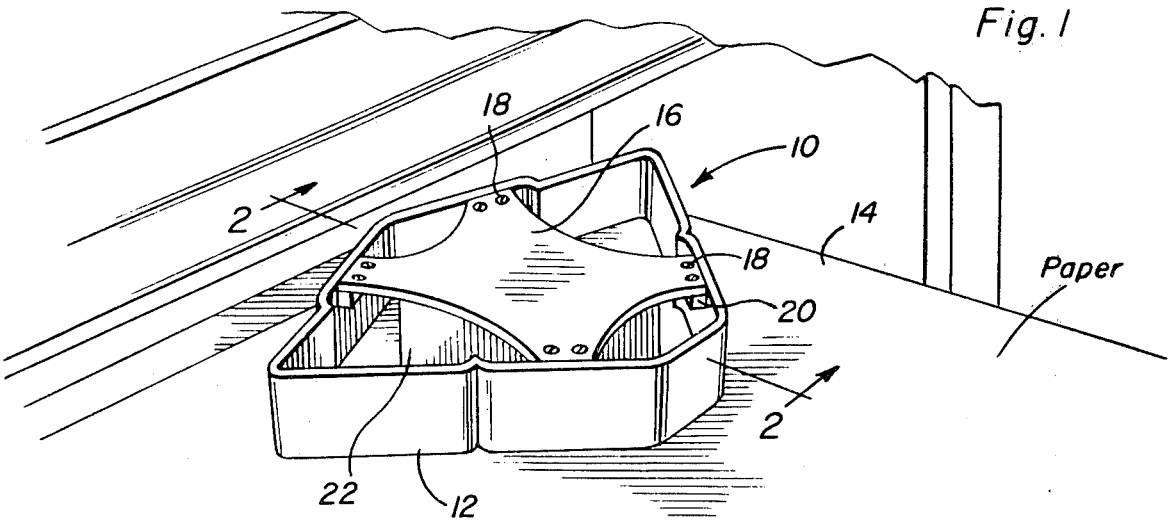
FIG. 1 is a perspective view of the die cutter and ejection attachment forming the present invention operably positioned on a stack of paper to be cut.

Reference is now made to the drawings and in particular to FIG. 1 wherein there is illustrated a horizontal cutting die arrangement forming the present invention including upstanding peripherally continuous wall portions and generally designated by the reference numeral 10.

In this respect, there is shown a hollow cutting die 12 operably positioned over a stack of paper 14 through which the die may be driven during a cutting operation. The paper cutting die 12 is of a configuration and shape which is employed to cut envelope blanks in paper, such blanks being then subsequently convertible into envelopes. In this connection, it can then be appreciated that the cutting die 12 could be of any particular shape and not just limited to the cutting of envelopes. Further illustrated in FIG. 1 is an attachment in the form of a die bracing and ejecting plate 16 which is fixedly secured to a topmost portion of the hollow cutting die 12. The ejecting plate 16 is mountable to the cutting die 12 through the use of a plurality of attachment means, such as screws 18, such screws being threadably securable to a plurality of connection bars 20 fixedly attached to an interior portion of the cutting die. Also partially illustrated in FIG. 1 is the use of a block of rubber 22 which is positioned within the interior portion of the cutting die 12 and which is bonded to an undersurface of the die ejecting plate 16.

Figure 2:
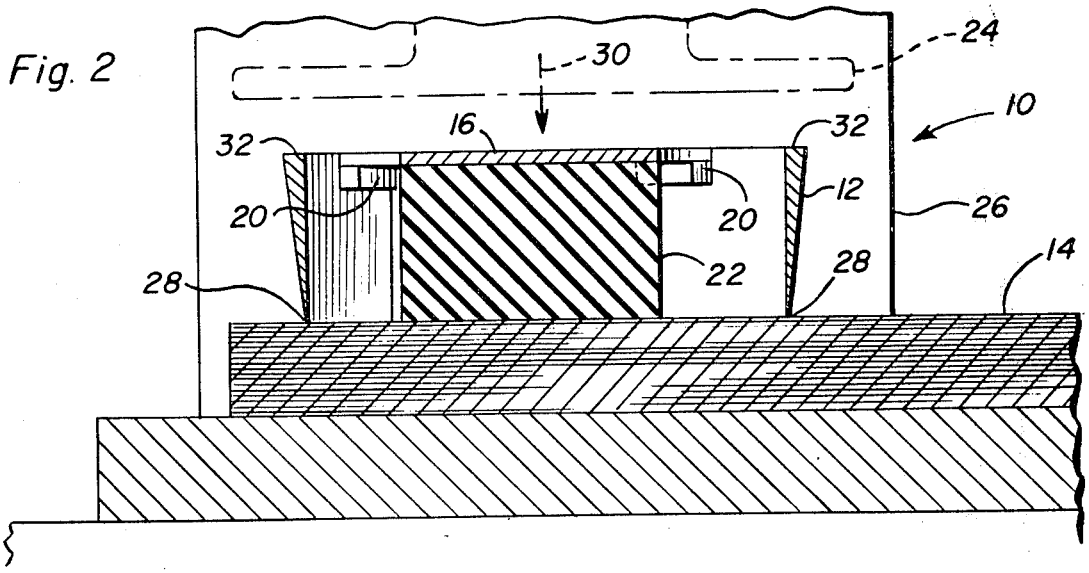
FIG. 2 is a transverse cross-sectional view of the present invention taken along the line 2—2 of FIG. 1 and illustrating the positioning of the die cutter just prior to a cutting operation being performed.

With reference to FIG. 2, the operation of the cutting die arrangement 10 can be more clearly understood. In this respect, the hollow cutting die 12 is again shown operably positioned on a stack of paper 14 such as one ream of paper prior to a cutting operation being performed. As illustrated, the paper cutting die 12 is of a portable construction and is positionable beneath a ram or hammer 24 associated with a paper cutting press 26 or the like with the hammer typically moving about 3½" to assure that the cutting die which has a 3½" height will cut through the 2½" thick ream of paper. When positioned on the stack of paper 14, the cutting die 12 has a lowermost knife-like edge 28 positioned in an abutting relationship with the paper, while the block of rubber 22 may also be in an abutting relationship with a top surface of the stack of paper. Of course, however, the block of rubber 22 may be of a height whereby no abutting relationship occurs between the rubber and the stack of paper 14 when the cutting die 12 is in the position illustrated in FIG. 2. It is necessary though to provide for a secure bond between the block of rubber 22 and the attachment plate 16, whether such bond be by gluing, mechanical fasteners, or the like. Such a construction then permits an automatic removal of the block of rubber 22 from the cutting area when the cutting die 12 is concurrently removed. With further reference then to FIG. 2, it can be appreciated that the ram or hammer 24 may be moved downwardly in the direction of the arrow 30 so as to come into an abutting engagement with a top surface 32 of the cutting die 12.

Figure 3:
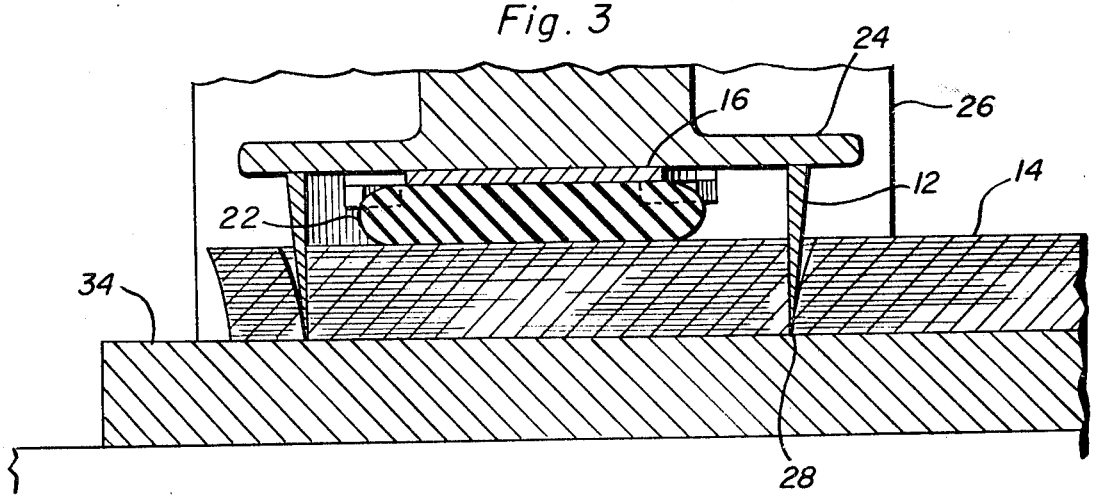
FIG. 3 is a transverse cross-sectional view of the present invention as it would appear during the paper cutting step of the die cutting operation.

Once such an abutment occurs, the ram or hammer 24 may be continually forced downward so as to effectively drive the cutting die 12 through the stack of paper 14 in the manner illustrated in FIG. 3. In this connection, it can be seen that the cutting die 12 will be driven through the paper 14 until the knife edge 28 comes into contact with a cutting table 34, thereby effectively cutting through the entire stack of paper. During this cutting step, it can be seen that the block of rubber 22, which is still fixedly secured to the ejecting plate 16, will be substantially compressed in the manner illustrated so as to provide a biasing force between the ejecting plate and the stack of paper 14.

Figure 4:
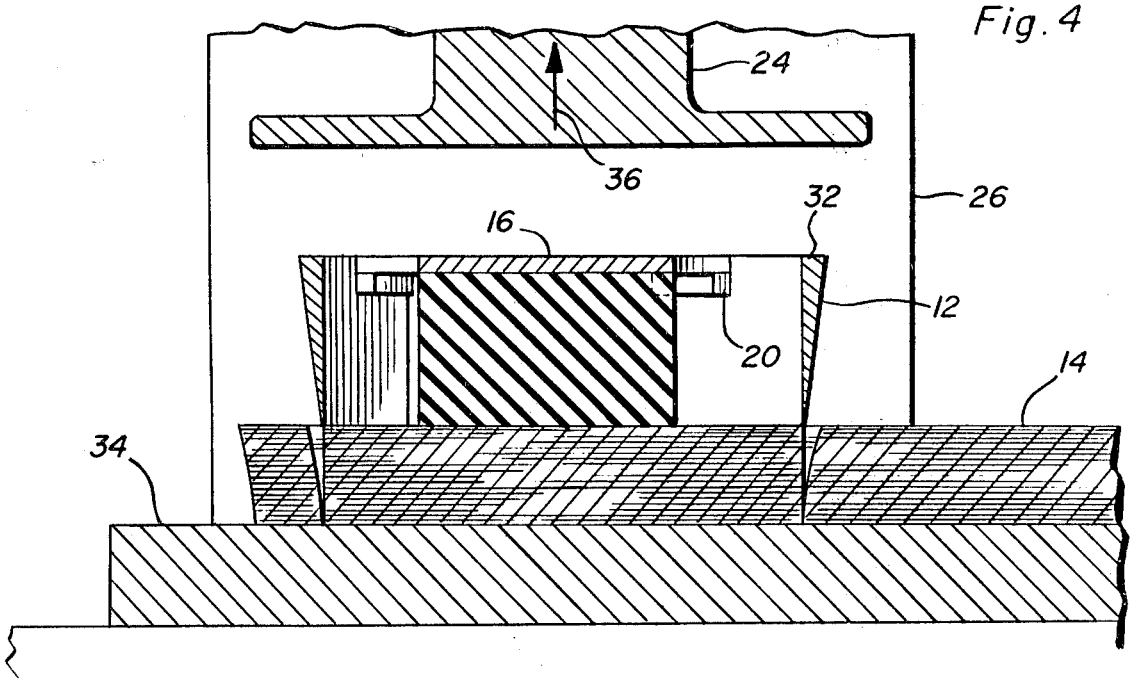
FIG. 4 is a transverse cross-sectional view of the present invention illustrating the positioning of the same subsequent to the paper cutting step.

Once the die 12 has been driven completely through the stack of paper 14, as shown in FIG. 3, the ram or hammer 24 will be automatically withdrawn by the paper cutting press 26 in the direction of the arrow 36 shown in FIG. 4. As the ram 24 is withdrawn, thus alleviating the downward pressure provided against the cutting die 12, the block of rubber 22 will tend to return to its prior shape as shown in FIG. 2, thus forcing the cutting die 12 upwardly out of the stack of paper 14 and into the position illustrated in FIG. 4. As such, the block of rubber 22 along with the die ejecting plate 16, which is fixedly secured to the cutting die 12, serves as a die ejecting system whereby a portable cutting die automatically removes itself from a stack of cut material once a portable cutting operation has been performed after which the cutting die and paper are moved to another position for a subsequent die cutting operation.

Figure 5:
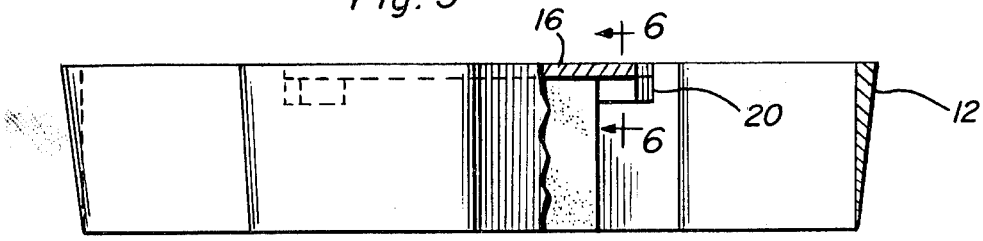
FIG. 5 is an elevational view, partly in section, of the present invention which illustrates the positioning of the die ejecting plate with respect to the connection bars.
Figure 6:
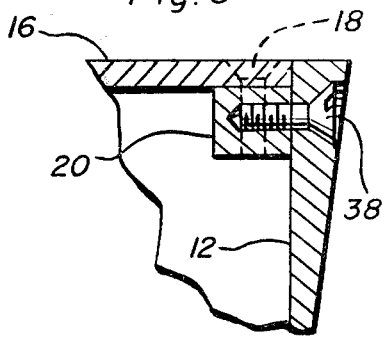
FIG. 6 is an enlarged cross-sectional detail view of the present invention taken along the line 6—6 of FIG. 5.

FIGS. 5 and 6 illustrate the structural details relating to the mounting of the die ejecting plate 16 to the topmost portion of the cutting die 12. In this connection, it can be seen that the ejecting plate 16 overlies a topmost portion of the individual connection bars 20 and is attachable thereto through the use of screws 18 as aforedescribed. As to the method of attaching the connection bars 20 to the interior portion of the cutting die 12, it can be seen that use might be made of an attachment screw 38 which is threadedly positionable within aligned apertures contained in the cutting die and the connection bars. In this respect, all of the attachment screws 18, 38 utilized in securely affixing the die ejecting plate 16, connection bars 20 and cutting die 12 to each other are of a countersunk construction to eliminate any chance of interference between the screw heads and their surrounding environment.

Figure 7:
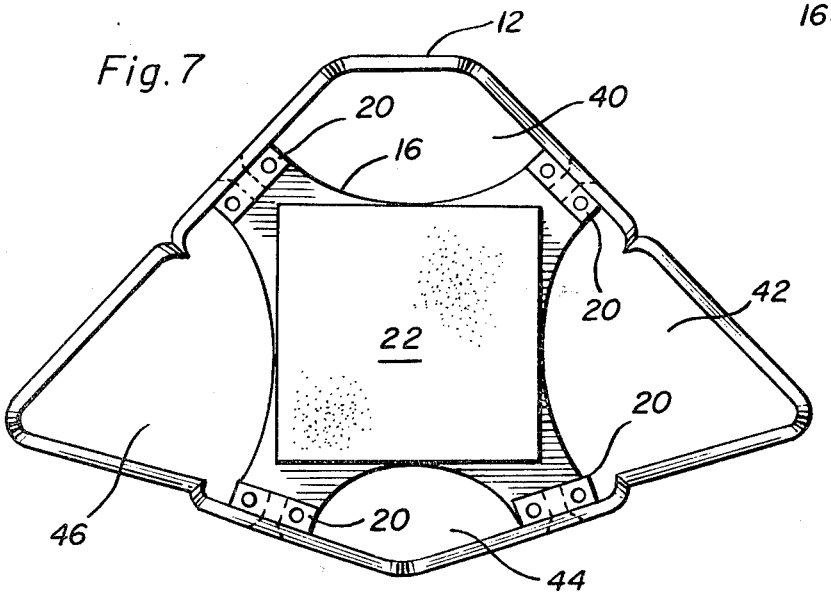
FIG. 7 is a bottom plan view of the present invention illustrating the positioning of the rubber block with respect to the die ejecting plate and die cutter.

FIG. 7, which is a bottom plan view of the present invention, has been provided to illustrate the positioning of the rubber block 22 on a bottommost portion of the die ejecting plate 16. While shown in a rectangular construction, it is to be understood that the rubber block 22 could be of any imaginable shape as long as enough rubber was present in the block so as to effect an ejectment of the cutting die 12 from the paper 14 once the cutting operation has been completed. Also illustrated in FIG. 7 is the fact that the die ejecting plate 16 is not of a shape which completely covers the top of the cutting die 12, but rather is of a shape which provides for a plurality of openings 40, 42, 44, 46. These openings 40, 42, 44, 46 allow for a few remaining sheets of paper, after the cutting action has been completed and the block 22 has upwardly ejected the die 12 from a cut stack of paper sheets, to be manually ejected from the die 12. Such a configuration is desirable since the edges of the upper sheets of paper within the die tend to upwardly expand within the die during a cutting operation and the upper sheets tend to bind within the die. The openings 40–46 serve not only as access openings to enable the block to be gripped and lifted from above the slate, but also to enable the upper cut sheets to be manually ejected from the die by a hand inserted downwardly through the openings.

In use then, it can be appreciated that the die ejecting plate might be used on any type of cutting die 12, i.e., dies that cut blanks other than for the manufacture of envelopes. In this respect, die ejecting plates 16 of any desired shape might be provided for use on cutting dies of any shape or function and could be quickly and efficiently mounted thereto through the use of connection bars 20 in the manner aforedescribed. By utilizing then a block of rubber 22 bonded to a bottommost portion of the die ejecting plate 16, a portable die is provided which may be quickly and efficiently slipped under a ram or hammer 24 to effect a cutting operation. Effectively, the ram 24 may be utilized to drive the cutting die 12 through a stack of paper 14 or any other type of sheet material, and the block of rubber which is compressed during the cutting operation will serve to eject the die from the sheet material once the ram 24 has been removed. The die 12 may then be manually removed from the stack of material so that the stamped out blanks may be removed for any desired use.

As such, the foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A peripherally continuous horizontal frame-type die for cutting predetermined shapes of sheet paper from a stack of sheet paper, the lower peripheral edge of said die being sharpened, a horizontal plate spanning and supported from remote peripheral portions of said die, a resilient paper ejecting block supported from and beneath said plate and generally centrally disposed within said die, said block being of a vertical thickness extending downwardly from said plate to a level at least generally flush with the lower peripheral edge of said die, said block being sufficiently spaced from opposing inner peripheral surfaces of said die to allow for horizontal expansion of said block responsive to vertical compression thereof with said block remaining spaced inwardly of all inner peripheral surfaces of said die when vertically compressed and horizontally expanded, said plate defining outwardly opening notches formed therein and spaced peripherally thereabout, said notches, together with opposing portions of said die, defining openings through said plate outwardly of the corresponding peripheral portions of said block, said plate extending between and being securely fastened to said remote peripheral portions of said die and functioning as a support for said paper ejecting block and with said notches being of sufficient size to define handgrip openings through said plate through which digital access from above may be readily gained for manually gripping of said block between spaced peripheral portions thereof in order to lift said die from said stack of sheet paper, said block serving to upwardly eject said die from said stack after downward force on said die to cut said stack is released and said openings further serving to enable manual ejection of a few cut sheets of paper remaining in said die after a cutting operation has been completed.

2. The die of claim 1 wherein said peripheral notches include two pairs of opposite side notches formed in said plate.

3. The die of claim 1 wherein the upper surface of said plate is free of projections extending upwardly above a plane containing the upper edges of said frame and substantially coplanar with said plane.

* * * * *